US006402861B1

(12) United States Patent
Katano et al.

(10) Patent No.: US 6,402,861 B1
(45) **Date of Patent: *Jun. 11, 2002**

(54) PROCESS FOR PRODUCING BASE FOILS OF ALUMINUM ALLOYS

(75) Inventors: Masahiko Katano, Fuji; Hidehiko Ishii, Nagoya, both of (JP); Iljoon Jin, Kingston (CA)

(73) Assignee: Alcan International Limited (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/529,946

(22) PCT Filed: Oct. 30, 1998

(86) PCT No.: PCT/JP98/04919

§ 371 (c)(1),
(2), (4) Date: May 24, 2000

(87) PCT Pub. No.: WO99/23269

PCT Pub. Date: May 14, 1999

(30) Foreign Application Priority Data

Oct. 31, 1997 (JP) ..... 9-316026

(51) Int. Cl.[7] ..... C22F 1/04
(52) U.S. Cl. ..... 148/551; 148/695
(58) Field of Search ..... 148/551, 695, 148/697, 437

(56) References Cited

U.S. PATENT DOCUMENTS 5,104,743 A * 4/1992 Nishikawa et al. ..... 428/472.2
5,725,695 A * 3/1998 Ward et al. ..... 148/552
6,159,313 A * 12/2000 Jin et al. ..... 148/551

FOREIGN PATENT DOCUMENTS

| | | | |
|---|---|---|---|
| JP | 61-119658 | | 6/1986 |
| JP | 61-170549 | | 8/1986 |
| JP | 6-93397 | | 4/1994 |
| JP | 6-101003 | | 4/1994 |
| JP | 6-101004 | | 4/1994 |
| JP | 6-93396 | | 4/1996 |
| WO | 95-18876 | * | 7/1995 |

* cited by examiner

*Primary Examiner*—George Wyszomierski
*Assistant Examiner*—Janelle Combs-Morillo
(74) *Attorney, Agent, or Firm*—Parkhurst & Wendel, LLP

(57) ABSTRACT

A process for the production of a base foil of an aluminum alloy is provided which comprises a first heating step in which a cold-rolled plate derived from a continuously cast-rolled plate is maintained at a temperature between higher than 350° C. and lower than 450° C. for longer than 0.5 hour, the cast-rolled plate being comprised of a Al-Fe-Si type aluminum alloy, the aluminum alloy containing Fe in a content between more than 0.3% by weight and less than 1.2% by weight and Si in a content between more than 0.20% by weight and less than 1% by weight and having a Si/Fe ratio between above 0.4 and below 1.2, and a second heating step in which the resultant plate is maintained at a temperature between higher than 200° C. and lower than 330° C. for longer than 0.5 hour. The base foil is substantially free of macroscopic and microscopic rib patterns on its rolled and mat surfaces.

8 Claims, 2 Drawing Sheets

Inventive Example
microscopic rib not observed ×200

FIG. 1 conventional example
macroscopic rib observed
PRIOR ART
rolling direction
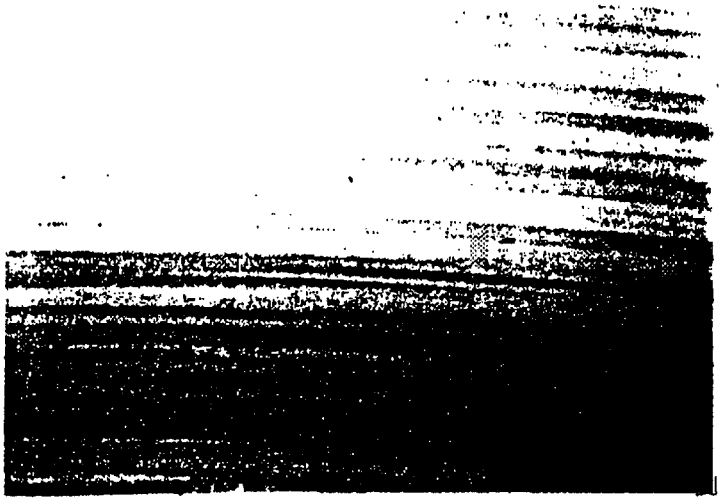
FIG. 2 conventional example
microscopic rib observed ×200
PRIOR ART
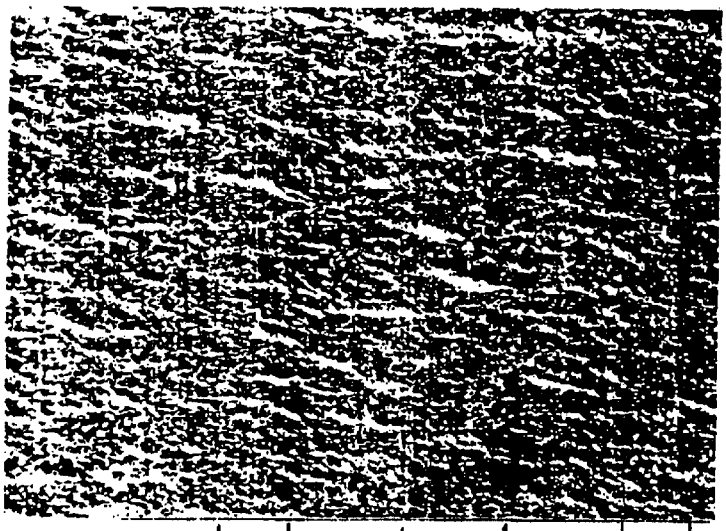
rolling direction
50 μm 80 μm 50 μm Inventive Example
macroscopic rib not observed rolling direction Inventive Example
microscopic rib not observed ×200 rolling direction

PROCESS FOR PRODUCING BASE FOILS OF ALUMINUM ALLOYS

BACKGROUND OF THE INVENTION

1. Field of the Invention

The present invention is directed to a process for the production of a base foil of an aluminum alloy that permits formation of an aluminum alloy foil that is highly strong and substantially free of rib-like patterns on both of its surfaces from all appearances.

2. Description of the Related Art

For their softness in character and rolling with ease, aluminum alloys have been applied, after being rolled to a thickness of approximately 5 to 150 $\mu$m, as aluminum alloy foils for wrapping of for example, foodstuffs, medicines, tobaccoes and so on.

Such aluminum alloy foils have been used in single-layered form or in multi-layered form in combination with paper, resin film or the like. Meanwhile, foils composed solely of an aluminum element and stipulated as JIS Type 1000 are limited in regard to their applications. For this reason, those foils of an Al—Fe alloy type containing Fe in an amount of about 0.3 to 1.5% by weight have today taken the place of the all-aluminum foils.

The Al—Fe alloy foils are produced by the steps of coating the associated hot melt, through a semi-continuous casting method, into a cast plate in a thickness in the order of 500 mm, heating the cast plate at an elevated temperature to thereby effect uniform heat treatment, hot rolling, cold rolling and intermediate annealing so that a base foil is prepared with a sheet thickness of about 0.3 mm. The base foil is finally rolled into a final foil of about 5 to 150 $\mu$m in thickness. In the case of a foil with a thickness of 5 mm, two intermediate foils derived at a stage just before the final stage are rolled in superimposed relation to each other.

However, the semi-continuous casting method involves segregation during casting, thus requiring not only surface planing in the range of about 5 to 10 mm and heat treatment for homogenization at from 500 to 600° C. and the like, but also hot rolling to reduce a cast plate of about 500 mm to a thickness of about 6 mm. Foil production using such a semi-continuous casting method has the drawback that it gives rise to decreased yield as well as added process steps and hence tedious production control.

On the other hand, a certain continuous casting method has been proposed in which an ingot is directly cast into a slab of 10 to 30 mm in thickness, which slab is continuously subjected to hot rolling. This continuous casting method has good productivity because it completes solidification at a higher speed than the semi-continuous casting method, thus entailing least segregation while in casting and enabling omission of surface planing of a cast lump of 500 mm in thickness and also of rolling permits the casting to a thickness of about 10 to 30 mm.

However, when an aluminum alloy foil is produced by the above continuous cast-rolling method, foil rolling gets diminished. To obviate this problem, it has been taught as in Japanese Unexamined Patent Publication No. 6-93397 that an aluminum alloy sheet containing Fe and Si and resulting from the continuous casting rolling method can be heat-treated twice so as to form a cold-rolled sheet. Advantageously, this treatment brings about reduced amounts of Fe and Si having received solid melting in supersaturated condition during cast rolling, thus leading to improved foil rolling with eventual formation of an aluminum base foil that offers excellent strength and sufficient foil rolling.

More specifically, the production process for an aluminum base foil cited above is comprised of continuously cast-rolling a hot melt of an aluminum alloy directly into a strip-like cast sheet of smaller than 25 mm in thickness, the aluminum alloy being composed of 0.2 to 0.8% by weight of Fe and 0.05 to 0.3% by weight of Si and the balance of Al and unavoidable impurities, subjecting the cast sheet to cold rolling in an extent of larger than 30% and subsequent heat treatment at a temperature of higher than 400° C., cold-rolling the heat-treated sheet at from 250 to 450° C. intermediately annealing the cold-rolled sheet, and finally cold-rolling the annealed sheet.

Here, Fe and Si present in the aluminum alloy have a role to render the resultant recrystal grains fine and to make the resultant foil strong. The cold rolling in an extent of larger than 30% and subsequent heat treatment at a temperature of higher than 400° C. contemplate scissioning the resulting crystals and breaking the solidified structure into a homogeneous structure such that the finished foil is prevented against rib-like patterns on one of its surfaces to be confronted (a mat surface), and impurities such as Fe, Si and the like are decreased which have been solid-molten while in casting. Consequently, improved foil rolling can be attained. Furthermore, the intermediate annealing treatment conducted at from 250 to 450° C. after the second cold rolling is intended to make the recrystal grains fine and, at the same time, to gain improved foil rolling with pinholes prevented from becoming undesirably increased.

However, ribbed patterns exerted on both of the mat and rolled surfaces of the foil are primarily because of the presence of a multilayered phase and the ununiformn or irregular distribution of intermetallic compounds in the course of casting, but not because of the remaining cast structure as will be described later. The two problems need to be solved at one time in alleviating ribbed patterns on the finished foil. In addition, in order to eliminate the irregular distribution of intermetallic compounds, a range of temperatures for heat treatment should be controlled with great precision since metallic compounds of Fe and Si are allowed to deposit at varying temperatures in a 250 to 450° C. range.

Strict requirements have lately been made for foils of an Al—Fe alloy type in respect of their surface qualities, and a quality level has been needed which should be favorably compared to that of an aluminum foil attained by the semi-continuous casting method. Namely, it has been demanded that an Al—Fe type alloy foil obtained by the above continuous casting method be improved since the foil is adversely affected by rib-like patterns produced on the rolled and mat surfaces. All of the ribbed patterns appear in a direction of rolling of the foil. The ribbed pattern on the rolled surface of the foil is of a macroscopic nature with a rib width of 2 to 10 nm (hereinafter called a macroscopic rib pattern, and reference made to a photograph of FIG. 1 of the accompanying drawings), whereas the ribbed pattern on the mat surface is of a miniscopic nature with a rib width of 10 to 100 $\mu$m (hereinafter called a microscopic rib pattern, and reference made to a photograph of FIG. 2). The two different rib patterns would presumably be due to their respective different mechanisms. No process for the production of an Al—Fe type alloy foil has been proposed to date in which a conventional Al—Fe type alloy foil could be simultaneously prevented against the macroscopic and microscopic rib patterns.

SUMMARY OF THE INVENTION

With the aforementined problems of the prior art in view, the present invention seeks to provide a process for the production of a base foil for use as an Al—Fe type alloy foil resulting from a continuous casting method, which base foil is substantially free of macroscopic and microscopic rib patterns and excellent in foil rolling.

As a result of their continued research to avoid the macroscopic and microscopic rib patterns on both surfaces of the foil as experienced in the prior art, the present inventors have found that a continuously cast-rolled plate derived from a hot melt of an Al—Fe—Si type alloy, such alloy being obtained by incorporating a sufficient amount of Si in an Al—Fe hot melt, can be formed into a plate of reduced thickness with a substantially a-single phase of AlFeSi (an a-phase of an Al—Fe—Si terelement on an Al side), and when an Al—Fe type compound (for example, $Al_3Fe$) and an Al—Fe—Si type compound ($Al_xFe_YSi$, $_{X,\ Y}$ are number) are caused to deposit during subsequent cold rolling, a foil can be attained with macroscopic and microscopic rib patterns avoided generally from external view.

According to one aspect of the present invention, there is provided a process for the production of a base foil of an aluminum alloy, which comprises a first heating step in which a cold-rolled plate derived from a continuously cast-rolled plate is heat-treated to promote deposition of an Al—Fe type compound, the cast-rolled plate being comprised of an Al—Fe—Si type alloy and having a substantially a-single phase of AlFeSi, and a second heating step in which the resultant plate is heat-treated to promote deposition of an Al—Fe—Si type compound after the first heating step.

According to another aspect of the invention, there is provided a process for the production of a base foil of an aluminum alloy, which comprises a first heating step in which a cold-rolled plate derived from a continuously cast-rolled plate is maintained at a temperature between higher than 350° C. and lower than 450° C. for longer than 0.5 hour, the cast-rolled plate being comprised of an Al—Fe—Si type aluminum alloy, the aluminum alloy containing Fe in a content between more than 0.3% by weight and less than 1.2% by weight and Si in a content between more than 0.20% by weight and less than 1% by weight and having a Si/Fe ratio between above 0.4 and below 1.2, and a second heating step in which the resultant plate is maintained at a temperature between higher than 200° C. and lower than 330° C. for longer than 0.5 hour.

BRIEF DESCRIPTION OF THE DRAWINGS

FIG. 1 is a photographic representation of a foil obtained from a continuously cast-rolled plate of the prior art, the foil having formed on its surface a macroscopic rib pattern.

FIG. 2 is a photographic representation of a foil obtained from a continuously cast-rolled plate of the prior art, the foil having formed on its surface a microscopic rib pattern.

DESCRIPTION OF THE PREFERRED EMBODIMENTS

Figure 3:
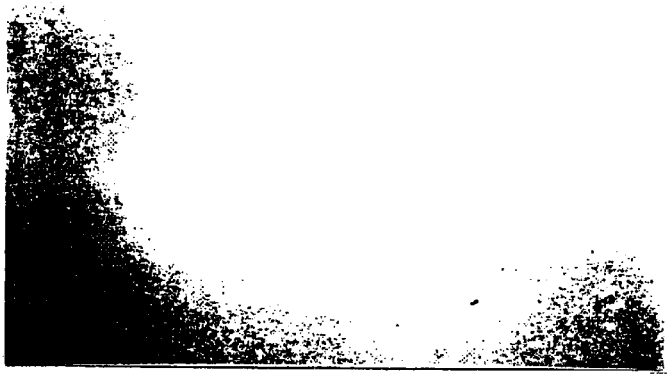
FIG. 3 is a photographic representation of a foil obtained from a base foil according to the process of the present invention, the foil being free of a macroscopic rib pattern on its surface to all appearances.

By the continuous cast-rolling method used herein is meant a method in which a hot melt is introduced in a casting mold provided with a continuous rotary or movable surface by means of a two-roll caster or a twin-belt caster, directly followed by casting the hot melt into a strip-like slab of a small thickness of about 10 to 50 mm and subsequent direct hot rolling of the slab into a plate with a given reduced thickness. The casting mold for use in this method is of a thin-walled water-cooling formation so as to attain good cooling effect. The casting mold is exposed to thermal strain in the course of casting. In brief, the continuous cast-rolling process according to the present invention is not limited to the casting method stated above, but is intended to continuously cast a strip-like slab with a small thickness of about 10 to 15 mm and to directly continuously roll the slab.

When Si is incorporated to exceed a specific content in a hot melt of an aluminum alloy, the resulting foil can be rendered substantially free of a macroscopic rib pattern. This phenomenon is-thought to be due to those reasons explained hereunder. That is, through a X-ray diffraction inspection by the present inventors of a macroscopic rib produced on a rolled surface of an Al—Fe type alloy foil, it has been found that the rib pattern is comprised of a multilayered phase with peculiar phases such as for example $Al_mFe$, $Al_6Fe$, $Al_3Fe$, a-AlFeSi and so on. The width of the rib is in the range of 2 to 10 mm that is similar to the amount of deformation of the surface of a casting mold during casting. Hence, the solidification speed of a hot melt becomes unstable depending upon contact or non-contact of the hot melt with the casting mold surface.

Moreover, a range of solidification temperatures is so limited that solidification shrinkage tends to occur with consequential formation of a multilayered phase with the above peculiarities. Upon subsequent cold rolling of such a metallic plate, differences arise in the force of friction with a roll and the thickness of a spontaneous oxidation film since the above phases have varying rolling properties and oxidation capabilities. This variation in turn invites varied light reflectance which would presumably appear to be a ribbed pattern.

Consequently, a range of solidification temperatures needs to be widened by adding Si in an amount exceeding a specific content to a hot melt of an Al—Fe type alloy. The hot melt thus prepared is directly cast into a plate of reduced thickness by use of the continuous cast-rolling process. In such instance, even if contact or non-contact of the hot melt with the surface of a casting mold makes the hot melt unstable in its solidification temperature, a thin-walled plate composed substantially of a single phase of a-AlFeSi can be provided. This thin-walled plate is of a single-phase arrangement and hence is not variable in regard to the force of friction with a roll and the thickness of a spontaneous oxidation film so that light reflectances of generally the same extent are attained, and a macroscopic rib pattern is believed hidden from external view.

Because the finished foil is required to afford sufficient strength, a hot melt of an Al—Fe—Si type alloy derived from incorporation of Si in a specific amount in a hot melt of an Al—Fe type alloy should have Fe contained in an amount of 0.3 to 1.2% by weight for practical purposes. In the case of Fe in the above specified content, the amount of Si to be added to form a single phase should be not less than 0.2% by weight, preferably more than 0.25% by weight, above 0.30% by weight so as to form a by far more stable single phase. The upper limit of Si should be not larger than 1% by weight, preferably below 0.8% by weight.

Besides and desirably, the Si/Fe ratio should be larger than 0.4. When such a hot melt is directly cast into a plate of reduced thickness by the continuous casting method, a thin-walled plate composed substantially of a single phase of a-AlFeSi can be obtained even if the solidification speed of the hot melt is made unstable owing to contact or non-contact of the hot melt with a roll. Larger contents of Si than 1% by weight and greater Si/Fe ratios than 1.2, however, make a coarse intermetallic compound of an Al—Fe—Si type easily liable to crystallize, thus causing broken foil while in foil rolling. It is desired, therefore, that the content of Si be not larger than 1% by weight, and the Si/Fe ratio be not greater than 1.2. Conversely, contents of Si smaller than 0.2% by weight and Si/Fe ratios smaller than 0.4 lead to a multilayered phase of an Al—Fe— type compound and an Al—Fe—Si type compound, eventually failing to offer those advantages accruing from the present invention.

With further regard to a cold-rolled plate derived from a continuously cast-rolled plate of such an Al—Fe—Si type alloy, heat treatment is carried out under specific conditions in order to deposit an Al—Fe type compound and an Al—Fe—Si type compound in the course of cold rolling with the result that a foil can be obtained without a microscopic rib pattern found on its mat surface by visual inspection. This phenomenon is considered attributed to those reasons explained hereunder. As a result of analyses by the present inventors of a microscopic rib pattern on a mat surface of a foil with use of a light microscope and a scanning type electron microscope, this microscopic rib pattern is characteristic of the kind and difference in amount of intermetallic compounds. The microscopic rib pattern is thought to result from variability in foil rolling, hence formation of coarsely aggregated wrinkles and densely aggregated wrinkles. Thus, it is also thought that no such rib pattern takes place when there is a smaller difference in the amount of intermetallic compounds.

To be more specific, an intermetallic compound of an Al—Fe type is allowed to deposit during cold rolling in a first heating step, and an intermetallic compound of an Al—Fe—Si type is then deposited in a second heating step so that the intermetallic compounds are substantially uniform, uniform rolling is possible without variation in foil rolling, and irregular aggregation of wrinkles is absent. Thus, the microscopic rib pattern is believed prevented against occurrence.

Adding Si in an amount exceeding a specific content in an Al—Fe type alloy contemplates, in addition to provision of a single-layered plate of a-AlFeSi, replenishing the amounts of intermetallic compounds. Namely, Fe left behind after deposition of a first or Al—Fe type alloy compound is caused to deposit in the form of an Al—Fe—Si type alloy compound.

In the first heating step in which heat treatment is effected with respect to a cold-rolled plate of an Al—Fe—Si type of the above specified composition, it is desired that the plate be maintained at a temperature between higher than 350° C. and lower than 450° C. for a longer length of time of 0.5 hour. Lower temperatures than 350° C. and shorter times than 0.5 hour make it difficult to sufficiently deposit an Al—Fe type intermetallic compound. Higher temperatures than 450° C. lead to solid-molten Fe, resulting in impaired rolling. Though not particularly restrictive, the upper limit of the retention time should be 12 hours or so from the point of view of economy. Desirably, the ratio of cold rolling prior to the first heating step should be made larger than 40% so that the grain size of recrystals can be set to be about, 30 to 100 mm.

In the second heating step after the first heating step, retention should preferably be conducted at a temperature of between higher than 200° C. and lower than 330° C. for 0.5 hour. Lower temperatures than 200° C. and times shorter than 0.5 hour fail to sufficiently deposit an Al—Fe—Si type intermetallic compound. Inversely, higher temperatures than 330° C. invite solid-molten Si, ultimately causing the plate to have reduced rolling capabilities. While not particularly restrictive, the retention time should be about 12 hours as the upper limit from a consideration of cost saving. Rolling is not particularly necessary between the first and second heating steps, but may be done in a ratio of about 40% to thereby adjust the grain size of recrystals.

The rolled plate allowed to pass through the first and second heating steps may be further rolled, where desired, into a base foil of a given thickness, for instance, of 0.2 to 0.4 mm. The resultant base foil is not regionally largely variable in the amounts of intermetallic compounds on both of its surfaces and hence is substantially uniform. The base foil may be further subjected to foil rolling and rolled in superimposed condition at the final stage with the consequence that a foil can be provided with a macroscopic rib pattern and a microscopic rib pattern observed generally from all appearances and with a quality level of favorably comparable to that an aluminum alloy foil obtained by means of a semi-continuous casting method.

In the practice of the present invention, etching may be preferred with respect to a surface of a thin-walled plate in a depth of about 0.01 to 0.2 $\mu$m as by a brush or an alkaline solution such as sodium hydroxide or the like. The etching may be effected at any stage up to formation of a base foil.

EXAMPLES

The present invention is further illustrated with reference to several examples as to the process for base foil production.

A hot melt of a composition corresponding to the number of an alloy shown in Table 1 was cast into a 16 mm thick slab by means of a twin-belt casting machine, directly followed by hot rolling of the slab to thereby obtain a 1.3 mm thick strip. After being cooled, the strip was cold-rolled to thickness of 0.6 mm. Intermediate annealing was made to the 0.6 mm thick strip, followed by cold rolling and foil rolling, whereby a foil was provided with a thickness of 15 $\mu$m. Performance evaluation was made of the resulting foil. The conditions for the intermediate annealing and the procedures of evaluation are given below.

(1) Intermediate Annealing

Condition 1:

390° C. '3-hour retention and then 250° C. '5-hour retention — inventive treatment Condition 2:

450° C. '8-hour retention and then 380° C. '5-hour retention — comparative treatment (2) Evaluation A macroscopic rib pattern was adjudged by visual inspection. A microscopic rib pattern was examined on the mat surface with use of a scanning type electron nicroscope, and the rib width was quantitatively determined from region of a relatively few wrinkles.

Figure 4:
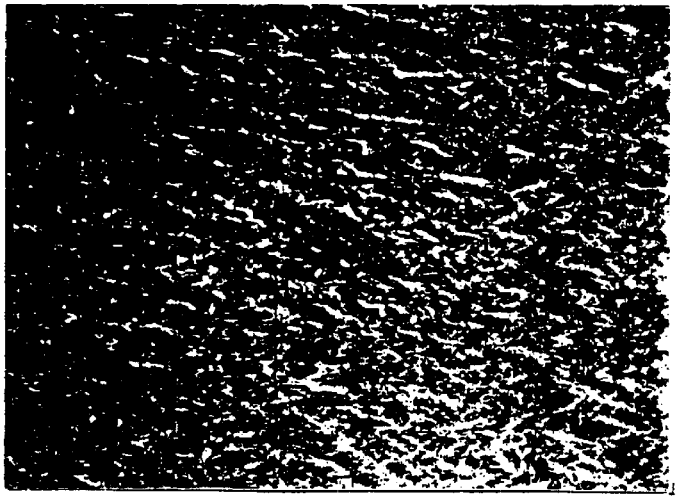
FIG. 4 is a photographic representation of a foil obtained from a base foil according to the process of the present invention, the foil being free of a microscopic rib pattern on its surface to all appearances.

The results are tabulated in Table 2. As is clear from Table 2, the examples according to the invention (specimen Nos. 1, 2, 4, 5, 6, 7 and 8) are excellent in foil rolling and substantially free of macroscopic and microscopic rib patterns. The surface states of the foil prepared as specimen No. 4 are photographically represented in FIG. 3 and FIG. 4.

The comparative examples outside the scope of the invention (specimen Nos. 3, 9, 10, 11 and 12) are unacceptable in either one of the tested properties.

TABLE 1

| Cast Lump Composition (unit: wt %) | | | |
|---|---|---|---|
| alloy No. | Si | Fe | Si/Fe |
| 1 | 0.3 | 0.3 | 1.00 |
| 2 | 0.3 | 0.5 | 0.60 |
| 3 | 0.3 | 0.7 | 0.43 |
| 4 | 0.5 | 0.5 | 1.00 |
| 5 | 0.5 | 1.1 | 0.45 |
| 6 | 0.8 | 0.8 | 1.00 |
| 7 | 0.8 | 1.1 | 0.73 |
| 8 | 0.07* | 0.3 | 0.23* |
| 9 | 0.3 | 1.0 | 0.30* |
| 10 | 0.7 | 0.5 | 1.40* |

Asterisks are outside the scope of the invention

TABLE 2

| Evaluation Results of Specimens | | | | | | | |
|---|---|---|---|---|---|---|---|
| specimen | alloy | intermediate annealing | foil | rib | | overall | |
| No. | No. | condition | rolling | macro | micro | evaluation | remark |
| 1 | 1 | 1 | ○○ | ○ | ○ | ○ | Inventive Example |
| 2 | 2 | 1 | ○○ | ○ | ○ | ○ | Inventive Example |
| 3 | | 2 | X | ○ | X | X | Comparative Example |
| 4 | 3 | 1 | ○○ | ○ | ○ | ○ | Inventive Example |
| 5 | 4 | 1 | ○○ | ○ | ○ | ○ | Inventive Example |
| 6 | 5 | 1 | ○ | ○ | ○ | ○ | Inventive Example |
| 7 | 6 | 1 | ○ | ○ | ○ | ○ | Inventive Example |
| 8 | 7 | 1 | ○ | ○ | ○ | ○ | Inventive Example |
| 9 | 8 | 1 | ○○ | X | X | X | Comparative Example |
| 10 | | 2 | ○ | X | X | X | Comparative Example |
| 11 | 9 | 1 | ○○ | X | ○ | X | Comparative Example |
| 12 | 10 | 1 | X | ○ | ○ | X | Comparative Example |

(1) foil rolling: ○○ . . . good, ○ . . . rolling possible, X . . . hard or broken
(2) macroscopic rib: ○ . . . not observed, X . . . observed
(3) microscopic rib: ○ . . . 20 μm or above absent, X . . . 50 μm or above present The process for the production of a base foil of an aluminum alloy according to the present invention exhibits high yield since it requires no planing of a continuously cast-rolled plate on its surface. From the resultant base foil, a foil is attainable with a high level of surface quality similar to that of a foil available from a semi-continuous casting method. Thus, the process of the invention is significantly excellent.

What is claimed is:

1. A process for the production of a base foil with a thickness of 0.2–0.6 mm of an aluminum alloy comprising:

(1) introducing into a casting mold a hot melt comprising an Al—Fe—Si type alloy containing (a) Fe in a quantity of more than 0.3% by weight and less than 1.2% by weight and (b) Si in a quantity of greater than 0.20% weight and less than 1% by weight, the alloy having a Si/Fe ratio between above 0.4:1 and below 1.2:1, (2) casting the hot melt into a strip-like slab, and then (3) hot rolling the strip-like slab into a cast-rolled plate composed substantially of a single phase of α-AlFeSi, steps (1), (2), and (3) constituting a continuous cast-rolling operation; and (4) undertaking one or more cold rolling steps to roll the cast-rolled plate into the base foil, and undertaking in and up to no later than directly after the last of said cold rolling steps (5) a first heating step and a second heating step to form the base foil, wherein (i) the first heating step heat-treats the cold-rolled plate to promote deposition of an Al—Fe type compound and (ii) the second heating step heat-treats the cold-rolled plate treated by the first heating step to promote deposition of an Al—Fe—Si type compound.

2. The process of claim 1, wherein the Al—Fe—Si type alloy has a Si content of greater than 0.30% by weight and less than 1% by weight.

3. A process for the production of a base foil with a thickness of 0.2–0.6 mm of an aluminum alloy comprising:

(1) introducing into a casting mold a hot melt comprising an Al—Fe—Si type alloy containing (a) Fe in a quantity of more than 0.3% by weight and less than 1.2% by weight and (b) Si in a quantity of greater than 0.20% weight and less than 1% by weight, the alloy having a Si/Fe ratio between above 0.4:1 and below 1.2:1, (2) casting the hot melt into a strip-like slab, and then (3) hot rolling the strip-like slab into a cast-rolled plate composed substantially of a single phase of a-AlFeSi, steps (1), (2), and (3) constituting a continuous cast-rolling operation; and (4) undertaking one or more cold rolling steps to roll the cast-rolled plate into the base foil, and undertaking in and up to no later than directly after the last of said cold rolling steps (5) a first heating step and a second heating step to form the base foil, wherein (i) the first heating step maintains the cold-rolled plate at a temperature greater than 350° C. and lower than 450° C. for a period longer than 0.5 hours and (ii) the second heating step maintains the cold-rolled plate treated by the first heating step at a temperature higher than 200° C. and lower than 330° C. for a period longer than 0.5 hours.

4. The process of claim 2, wherein the Al—Fe—Si type alloy has a Si content of greater than 0.30% by weight and less than 1% by weight.

5. The process for the production of a base foil of an aluminum alloy comprising:

(1) introducing into a casting mold a hot melt comprising an Al-Fe-Si type alloy containing (a) Fe in a quantity of more than 0.3% by weight and less than 1.2% by weight and (b) Si in a quantity of greater than 0.20% weight and less than 1% by weight, the alloy having a Si/Fe ratio between above 0.4:1 and below 1.2:1 , (2) casting the hot melt into a strip-like slab, and then (3) hot rolling the strip-like slab into a cast-rolled plate composed substantially of a single phase of α-AlFeSi, steps (1), (2), and (3) consituting a continuous cast-rolling operation; and (4) undertaking one or more cold rolling steps to roll the cast-rolled plate into the base foil, and undertaking in and up to no later than directly after the last of said cold rolling steps (5) a first heating step and a second heating step to form a base foil, wherein (i) the first heating step heat-treats the cold-rolled plate to promote deposition of an Al-Fe type compound, (ii) the second heating step heat-treats the cold-rolled plate treated by the first heating step to promote deposition of an Al-Fe-Si type command, and (iii) no cold rolling occurs between heating steps (i) and (ii).

6. The process of claim 5, wherein the Al-Fe-Si type alloy has a Si content of greater than 0.30% by weight and less than 1% by weight.

7. A process for the production of a base foil of an aluminum alloy comprising:

(1) introducing into a casting mold a holt melt comprising an Al-Fe-Si type alloy containing (a) Fe in a quantity of more than 0.3% by weight and less than 1.2% by weight and (b) Si in a quantity of greater than 0.20% weight and less than 1% by weight, the alloy having a Si/Fe ratio between above 0.4:1 and below 1.2:1, (2) casting the hot melt into a strip-like slab, and then (3) hot rolling the strip-like slab into a cast-rolled plate composed substantially of a single phase of α-AlFeSi, steps (1), (2), and (3) constituting a continuous cast-rolling operation; and (4) undertaking one or more cold rolling steps to roll the cast-rolled plate into the base foil, and undertaking in and up to no later than directly after the last of said cold rolling steps (5) a first heating step and a second heating step to form a base foil, wherein (i) the first heating step maintains the cold-rolled plate at a temperature greater than 350° C. and lower than 450° C. for a period longer than 0.5 hours, (ii) the second heating step maintains the cold-rolled plate treated by the first heating step at a temperature higher than 200° C. and lower than 330° C. for a period longer than 0.5 hours, and (iii) no cold rolling occurs between treating steps (i) and (ii).

8. The process of claim 7, wherein the Al-Fe-Si type alloy has a Si content of greater than 0.30% by weight and less than 1% by weight.

* * * * *